US008430277B2

(12) United States Patent
Dumont et al.

(10) Patent No.: US 8,430,277 B2
(45) Date of Patent: Apr. 30, 2013

(54) SYSTEM FOR DISPENSING A FLUID PRODUCT

(75) Inventors: Pierre Dumont, Incheville (FR); Jean-Luc Marcel Octau, Intraville (FR); Thomas Roosel, Notre d'Aliermont (FR); Bernard Clerget, Haudivillers (FR)

(73) Assignee: Rexam Dispensing Systems S.A.S. (FR)

( * ) Notice: Subject to any disclaimer, the term of this patent is extended or adjusted under 35 U.S.C. 154(b) by 139 days.

(21) Appl. No.: 13/162,263

(22) Filed: Jun. 16, 2011

(65) Prior Publication Data

US 2011/0309110 A1 Dec. 22, 2011

(30) Foreign Application Priority Data

Jun. 16, 2010 (FR) ..... 10 02558

(51) Int. Cl.
*B65D 83/00* (2006.01)

(52) U.S. Cl.
USPC ..... 222/402.1; 222/402.18; 222/402.23

(58) Field of Classification Search ..... 222/394, 222/402.1, 402.18, 402.22, 402.23, 402.24, 222/402.25, 321.7, 321.9
See application file for complete search history.

(56) References Cited

U.S. PATENT DOCUMENTS

| | | | | |
|---|---|---|---|---|
| 3,556,171 | A | 1/1971 | Gangwisch | |
| 3,743,189 | A * | 7/1973 | Macquire-Cooper | 239/579 |
| 3,912,132 | A * | 10/1975 | Stevens | 222/402.1 |
| 5,702,036 | A * | 12/1997 | Ferrara, Jr. | 222/402.13 |
| 6,196,424 | B1 * | 3/2001 | Bougamont et al. | 222/321.9 |
| 6,666,357 | B2 * | 12/2003 | Bougamont et al. | 222/321.9 |
| 6,729,504 | B2 * | 5/2004 | Bougamont et al. | 222/189.09 |
| 6,978,914 | B2 * | 12/2005 | Furner et al. | 222/402.1 |
| 7,735,692 | B2 * | 6/2010 | Nelson | 222/190 |
| 8,056,770 | B2 * | 11/2011 | Lompech et al. | 222/321.2 |
| 2003/0150882 | A1 * | 8/2003 | Bougamont et al. | 222/321.9 |
| 2006/0151541 | A1 * | 7/2006 | Pares Montaner et al. | 222/321.2 |

FOREIGN PATENT DOCUMENTS

| | | | |
|---|---|---|---|
| EP | 0008662 | A1 | 3/1980 |
| FR | 2856991 | A1 | 1/2005 |

OTHER PUBLICATIONS

French Search Report and Written Opinion; Application No. FR 1002558; Issued: Feb. 3, 2011; 6 pages.

* cited by examiner

*Primary Examiner* — Frederick C. Nicolas
(74) *Attorney, Agent, or Firm* — St. Onge Steward Johnston & Reens LLC

(57) ABSTRACT

A system for dispensing a fluid product, including a device for taking the product off under pressure that is equipped with an outlet tube, the system also including a push button actuating the device in which a chamber is formed for dispensing the product that is in communication with a well for mounting the push button, the well being arranged to be associated sealingly around an area for mounting the outlet tube so as to allow supply to the chamber dispensing product under pressure emerging from the tube, the outlet tube including a vent recess having at least one opening that is formed in the mounting area and that emerges inside the tube, the opening being located on the mounting area so as to be covered sealingly by the mounting well and to open the inside of the outlet tube to open air when it is not covered.

10 Claims, 2 Drawing Sheets

SYSTEM FOR DISPENSING A FLUID PRODUCT

CROSS-REFERENCE TO RELATED APPLICATIONS

The present application claims priority of French patent application No. 1002558 filed on Jun. 16, 2010, the content of which is incorporated herein by reference.

FIELD OF THE INVENTION

The invention concerns a system for dispensing a fluid product, comprising a device for taking off said product under pressure that is actuated by a push button. The invention also concerns a dispensing bottle comprising such a dispensing system.

BACKGROUND OF THE INVENTION

In a particular application, the dispensing system is intended to equip bottles used in perfumery or cosmetics or for pharmaceutical treatments. This type of bottle contains a product that is retrieved under pressure by a pump of a manual-actuation valve by means of a push button that is arranged to dispense the product.

Conventionally, the taking-off device is equipped with a tube for discharging the product under pressure and the push button has a dispensing chamber that is in communication with a mounting well, said well being arranged to be associated sealingly around a mounting area of said tube in order to enable said chamber to be supplied with product under pressure brought by said tube.

In addition to the dispensing of the packaged product, the dispensing bottles may also, after removal of the push button, serve as a source for filling rechargeable bottles by decanting. This is because, for example for reasons of practicality or environmental recycling reasons, it may be desirable to be able to recharge the bottle with product from a source of said product, in particular when the rechargeable bottle has a capacity less than that of the source bottle, for example being intended to dispense product samples.

Such rechargeable bottles are already offered for sale, consisting of a reservoir, a pump or a take-off valve and a filling valve that opens when it is in abutment on the outlet tube of a source bottle, the decanting of the product taking place by pressing and pushing in said outlet tube.

To achieve this decanting, it is necessary to achieve a good seal between the outlet tube and the filling valve. For this purpose, filling valves comprise as standard a flexible cone or a flat seal made from flexible material, often of the elastomeric type. Thus, when the user presses on the outlet tube, he at the same time achieves a seal between the outlet tube and the valve, respectively by sealing on the external top edge on the top end of the outlet tube.

However, some vendors of dispensing bottles, in particular perfumers, wish for it to be impossible to decant the content of a bottle of their make into a standard rechargeable bottle, or for such decanting to be possible only into rechargeable bottles of their make.

SUMMARY OF THE INVENTION

The invention aims to improve the prior art by proposing in particular a dispensing system that limits the possibility of decanting of the product into a rechargeable bottle, in particular by preventing such decanting by means of the standard filling valves described above.

To this end, and according to a first aspect, the invention proposes a system for dispensing a fluid product comprising a device for taking said product off under pressure that is equipped with an outlet tube, said system also comprising a push button actuating said device in which a chamber is formed for dispensing the product that is in communication with a well for mounting said push button, said well being arranged to be associated sealingly around an area for mounting the outlet tube so as to allow supply to the chamber dispensing a product under pressure emerging from said tube, the outlet tube comprising a vent recess having at least one opening that is formed in the mounting area and that emerges inside said tube, said opening being located on the mounting area in order to be covered sealingly by the mounting well and to open the inside of the outlet tube to open air when it is not covered.

According to a second aspect, the invention proposes a bottle for dispensing a fluid product comprising a reservoir for packaging said product and such a dispensing system that is mounted on the reservoir so as to enable said product to be dispensed by actuation of the push button.

BRIEF DESCRIPTION OF THE DRAWINGS

Other objects and advantages of the invention will emerge in the following description given with reference to the accompanying figures, in which.

DETAILED DESCRIPTION OF THE INVENTION

Figure 1:
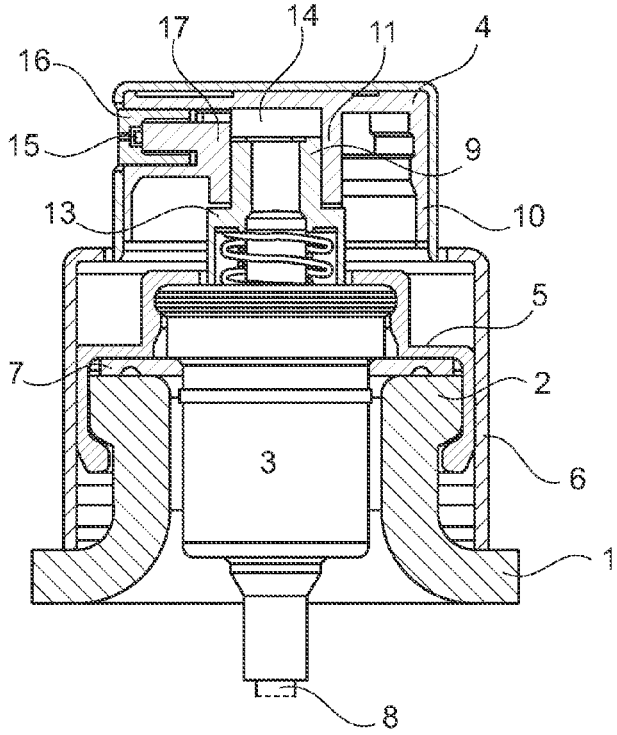
FIG. 1 is a partial view in longitudinal section of a bottle equipped with a dispensing system according to one embodiment of the invention.

In relation to the figures, a description is given below of a bottle for dispensing a fluid product under pressure, said product being able to be of any nature, in particular used in perfumery or cosmetics or for pharmaceutical treatments.

The bottle comprises a body 1 that can be formed from rigid material, in particular glass or plastics material, to define a reservoir for packaging said product. The body 1 is surmounted by a neck 2 formed in a single piece with said body, defining a top opening for the reservoir.

The bottle also comprises a dispensing system mounted in the top opening so as to enable the packaged product to be dispensed. To do this, the dispensing system comprises a device 3 for taking off liquid under pressure that is actuated manually by means of a push button 4.

In particular, the taking-off device 3 can comprise a pump or valve in the case where the liquid is packaged under pressure. In the embodiment shown, the taking-off device is a pump 3 (not shown in cross section in the figures) that comprises a body the periphery of which is mounted without clamping in the opening. To provide the positioning and fixing of the pump 3 on the neck 2, the dispensing system also comprises a sleeve 5 secured to the pump 3, said sleeve being held on the neck 2 by means of a hoop 6 with a seal 7 interposed.

The body of the pump 3 has a bottom part that is provided with a supply orifice, the supply means comprising a plunger tube 8 having a top part fixed in said orifice and a bottom part disposed against the bottom of the reservoir. Moreover, opposite the plunger tube 8, the pump is equipped with a tube 9 for discharging product under pressure.

The push button 4 comprises a body having an annular-shaped skirt 10 that surrounds a well 11 mounting the push button 4 on the outlet tube 9. More precisely, the well 11 is arranged so as to be associated sealingly around an area 12 for mounting the outlet tube 9.

In the embodiments shown, the well 11 has a cylindrical bore and the mounting area 12 has a top part 12*a* of frustoconical geometry, an annular groove 12*b* and a cylindrical bottom part 12*c*. In addition, the mounting area 12 is formed above an external shoulder 13 of the outlet tube 9, the well 11 being fitted around said area until it comes into axial abutment on said shoulder.

A product dispensing chamber is formed in the push button 4, said chamber being in communication with the well 11. In the embodiments shown, the dispensing chamber comprises an internal channel 14 and a vortex assembly 15 formed inside a nozzle 16 attached to an anvil 17 of the push button 4, said assembly having a vortex chamber equipped with a dispensing orifice.

According to a known embodiment, the push button 4 actuates the outlet tube 9 in reversible translation over a dispensing travel and a piston is also mounted on said tube between an obturation state and a state supplying the orifices of said tube so as to enable the product to be brought under pressure inside the outlet tube 9. Thus the dispensing chamber is supplied with product under pressure brought by the outlet tube 9 to enable the product to be sprayed through the dispensing orifice.

The outlet tube 9 comprises a vent recess that has at least one opening 18 formed in the mounting area 12 and emerges inside the tube 9. To enable the product to be dispensed, the opening 18 is located on the mounting area 12 so as to be covered sealingly by the mounting well 11 in order to obtain the sealed supply of the dispensing chamber with product under pressure leaving the tube 9.

In addition, the opening 18 is located on the mounting area 12 to put the inside of the outlet tube 9 to open air when said opening is not covered. Thus withdrawal of the push button 4 by traction makes the mounting area 12 accessible by uncovering the opening 18 and, in the case of mounting of the outlet tube 9 in a filling valve of a rechargeable bottle, the opening 18 can be located so as not to be covered by said valve so as to prevent the fluidtightness necessary for decanting. In a variant, the opening 18 can be located so as to be covered only by a particular valve so as to allow decanting only with this type of valve.

Figure 2:
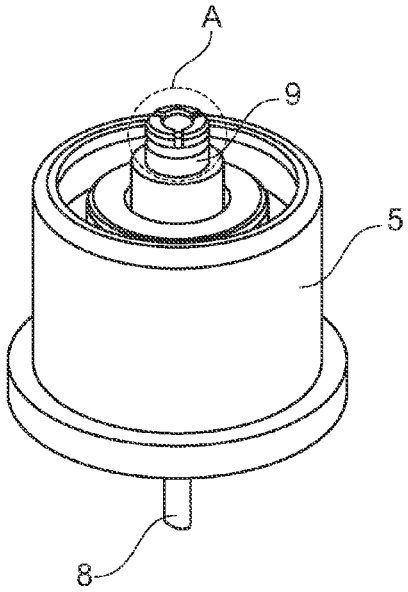
FIG. 2 is a view in perspective of the dispensing system of FIG. 1 in which the push button has been removed.
Figure 2A:
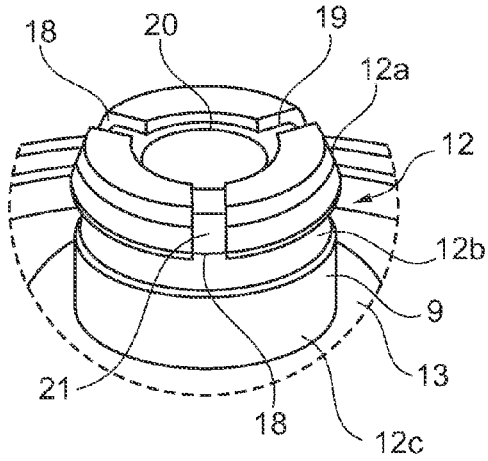
FIG. 2*a* is an enlarged view of area A of FIG. 2 showing the outlet tube mounting area.
Figure 3:
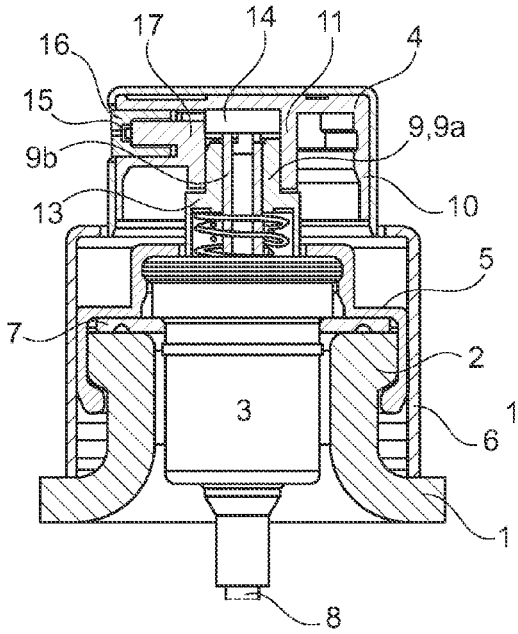
FIG. 3 is a partial view in longitudinal section of a bottle equipped with a dispensing system according to one embodiment of the invention.
Figure 3A:
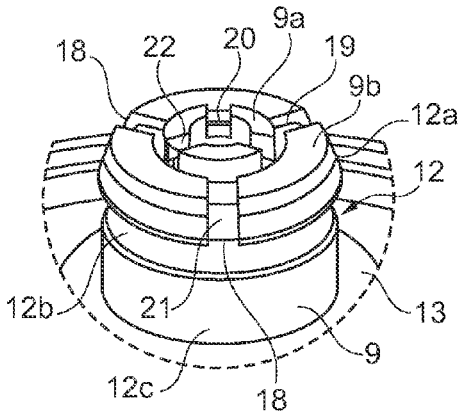
FIG. 3*a* being a view similar to FIG. 2*a* for this embodiment.

In relation to FIGS. 1 to 3, the vent recess has at least one groove 19 that extends radially from the mounting area 12, said groove being formed on the top end of the outlet tube 9. Advantageously, the radial groove 19 emerges in an annular groove 20 that is in peripheral communication with the inside of the outlet tube 9.

In this embodiment, sealing by pressing of the top end of the outlet tube 9 on a flat seal of a filling valve is made impossible, in particular by providing for the groove 19 to be of sufficient size not to be blocked by the flat seal when pressing on the outlet tube 9.

In addition, in order also to make a seal on a flexible cone impossible, the radial groove 19 can be extended by an axial groove 21 that is formed on the top part 12*a* of the mounting area 12, said axial groove emerging in the annular groove 12*b*. In particular, the axial groove 21 may have a length greater than that of the cone so as to prevent sealing by pressing. In the embodiment shown, the vent recess comprises three sets of grooves 19, 21 equally distributed angularly on the outlet tube 9.

According to one embodiment, the outlet tube 9 has a central tube 9*a* around which there is mounted an insert 9*b* on which the mounting area 12 is formed. In order to put the opening 18 of the vent recess in communication with the interior of the outlet tube 9, the central tube 9*a* has at least one groove 22 that is in communication with said opening.

With reference to FIG. 3, the top end of the central tube 9*a* has three equally distributed radial grooves 22, said grooves being offset angularly with respect to the radial grooves 19 of the insert 9*b* and being in communication with them through the annular groove 20.

Figure 4:
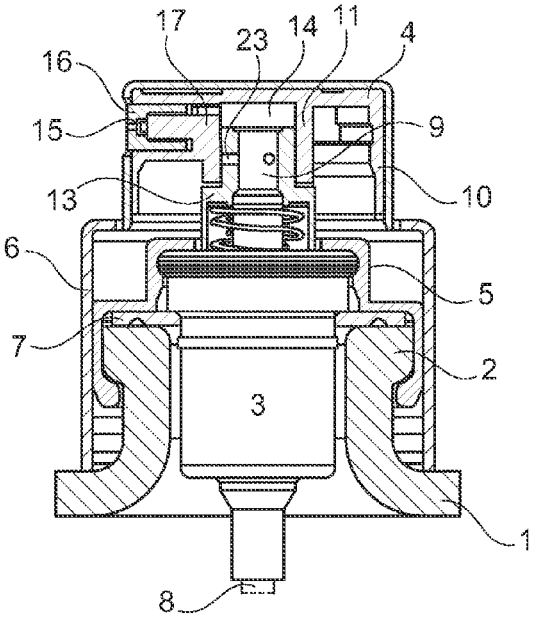
FIG. 4 is a partial view in longitudinal section of a bottle equipped with a dispensing system according to one embodiment of the invention.
Figure 4A:
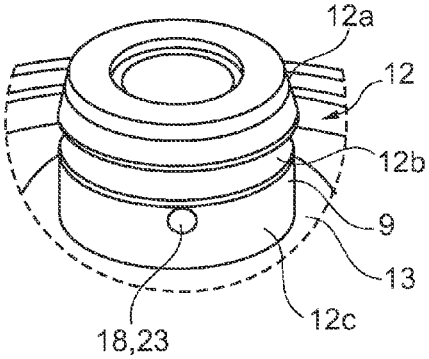
FIG. 4*a* being a view similar to FIG. 2*a* for this embodiment.

According to the embodiment in FIG. 4, the vent recess has at least one radial channel 23 that passes through the wall of the outlet tube 9. In particular, the channel 23 can be formed in the bottom part 12*c* of the mounting area 12 so that decanting can be possible only with a filling valve where the length of fitting on the outlet tube 9 is great. In a variant that is not shown, the channel 23 can be formed in the annular groove 12*b*.

What is claimed is:

1. System for dispensing a fluid product, comprising a device for taking off said product under pressure that is equipped with an outlet tube, said system also comprising a push button actuating said device in which a chamber is formed for dispensing the product that is in communication with a well for mounting said push button, said well being arranged so as to be associated sealingly around an area for mounting the outlet tube so as allow supply to the chamber dispensing product under pressure emerging from said tube, said system being characterized in that the outlet tube comprises a vent recess having at least one opening that is formed in the mounting area and emerges inside said tube, said opening being located on the mounting area so as to be covered sealingly by the mounting well and to open the inside of the outlet tube to open air when it is not covered.

2. The dispensing system according to claim 1, wherein the vent recess has at least one groove that extends radially from the mounting area, said groove being formed on the top end of the outlet tube.

3. The dispensing system according to claim 2, wherein the radial groove emerges in an annular groove that is in peripheral communication with the inside of the outlet tube.

4. The dispensing system according to claim 2, wherein a radial groove is extended by an axial groove that is formed on the mounting area.

5. The dispensing system according to claim 4, wherein the mounting area has an annular throat, the axial groove emerging in said throat.

6. The dispensing system according to claim 1, wherein the mounting area has a top part with a frustoconical geometry.

7. The dispensing system according to claim 1, wherein the vent recess has at least one radial channel that passes through a wall of the outlet tube.

8. The dispensing system according to claim 1, wherein the outlet tube has a central tube around which there is mounted an insert on which the mounting area is formed, said central tube having at least one groove that is in communication with the opening in order to put said opening in communication with the inside of said central tube.

9. The dispensing system according to claim 1, wherein the outlet tube has an external shoulder above which the mounting area extends.

10. A bottle for dispensing a fluid product, comprising a reservoir for packaging said product and the dispensing system according to claim 1 that is mounted on the reservoir as to enable said product to be dispensed by actuation of the push button.

* * * * *